US006796385B1

(12) United States Patent
Cobzaru et al.

(10) Patent No.: US 6,796,385 B1
(45) Date of Patent: Sep. 28, 2004

(54) FASTENER DRIVING MACHINE AND ASSOCIATED METHOD

(75) Inventors: Cristinel Ovidiu Cobzaru, Murrieta, CA (US); Charles Henry Dibley, Mission Viejo, CA (US)

(73) Assignee: Alcoa Global Fasteners, Inc., Torrance, CA (US)

( * ) Notice: Subject to any disclaimer, the term of this patent is extended or adjusted under 35 U.S.C. 154(b) by 8 days.

(21) Appl. No.: 10/387,815

(22) Filed: Mar. 13, 2003

(51) Int. Cl.[7] ..... E21B 7/00
(52) U.S. Cl. ..... 173/1; 173/29; 173/216
(58) Field of Search ..... 173/1, 29, 216; 227/142; 81/57.13, 57.26, 57.29

(56) References Cited

U.S. PATENT DOCUMENTS

| | | | | | |
|---|---|---|---|---|---|
| 2,268,802 | A | * | 1/1942 | Coffman | 74/396 |
| 2,824,299 | A | * | 2/1958 | Haines et al. | 340/678 |
| 2,884,103 | A | * | 4/1959 | Connell | 192/56.53 |
| RE27,550 | E | | 1/1973 | Bangerter | |
| 3,834,467 | A | | 9/1974 | Fuchs | |
| 3,901,098 | A | | 8/1975 | Jinkins | |
| 3,987,692 | A | * | 10/1976 | Lesner et al. | 81/57.13 |
| 4,171,651 | A | * | 10/1979 | Dacunto | 81/57.29 |
| 4,258,594 | A | | 3/1981 | Welch | |
| 4,287,795 | A | * | 9/1981 | Curtiss | 81/57.26 |
| 4,947,942 | A | | 8/1990 | Lightle et al. | |
| 5,052,496 | A | | 10/1991 | Albert et al. | |
| 5,522,286 | A | * | 6/1996 | Wilson et al. | 81/57.26 |
| 5,533,581 | A | * | 7/1996 | Barth et al. | 173/216 |
| 5,538,089 | A | * | 7/1996 | Sanford | 173/2 |
| 5,577,425 | A | | 11/1996 | Holmin et al. | |
| 5,950,509 | A | | 9/1999 | Doong | |
| 6,009,776 | A | * | 1/2000 | Warren | 81/57.29 |
| 6,035,745 | A | * | 3/2000 | Kather | 81/57.13 |
| 6,435,285 | B1 | | 8/2002 | Tsai | |
| 2001/0030051 | A1 | | 10/2001 | Hanke | |

* cited by examiner

*Primary Examiner*—Stephen F. Gerrity
*Assistant Examiner*—Nathaniel Chukwurah
(74) *Attorney, Agent, or Firm*—Brij K. Agarwal

(57) ABSTRACT

An improved fastener driving machine includes a driver, a support, a gear mechanism, an indexing apparatus, and a head. The head is movable among a plurality of positions with respect to the driver. The machine is advantageously structured to provide a substantially constant level of torque to a delivery point on the head independent of the position of the head with respect to the driver. The gear mechanism and the indexing apparatus are both disposed on the support, with the result that the mechanical operations of the gear mechanism are separate from the mechanical operations of the indexing apparatus. The indexing apparatus includes a number of tapered first teeth and a number of tapered second teeth that are securable to one another in a number of configurations to permit the head to be movably indexed to a number of positions with respect to the driver. The first and second teeth are biased together, and the indexing apparatus additionally includes a lock that locks the first and second teeth into engagement. An improved method is also disclosed.

44 Claims, 8 Drawing Sheets

FASTENER DRIVING MACHINE AND ASSOCIATED METHOD

FIELD OF THE INVENTION

The present invention relates generally to fastener driving machinery and, more particularly, to a fastener driving machine having a head that is movable among a plurality of positions and that provides a constant torque from the head regardless of the position of the head.

BACKGROUND OF THE INVENTION

Numerous types of fasteners are known and understood in the relevant art to fasten structures to one another and for other understood purposes. Among the various types of fasteners are threaded fasteners such as nuts, bolts, screws, and the like, deformable fasteners such as rivets and deformable threaded systems, and specially configured fasteners such as bayonet fasteners, among numerous other types of fasteners such as adhesives and welding operations. In certain applications, it is desired that certain fasteners have highly specific characteristics. For instance, threaded fasteners that are employed in the aerospace industry often must be tightened to a highly accurate level of torque to ensure the reliable and safe operation of the resulting structure. It is thus known to provide nut driving machinery that is configured to drive threaded fasteners such as nuts until the nuts reach a highly specific level of torque.

It is also known, however, that fasteners employed in aerospace applications often must be mounted within the tight confines of extremely small and cramped spaces to which much machinery can be inaccessible. It thus has been known to provide fastener driving machinery having heads that are movable among a plurality of positions in order to facilitate the attachment of threaded fasteners in hard to reach places. One such apparatus is a 17° offset fastener driving machine that employs a motor, a gear apparatus, and a head, with the head being movable in a plurality of positions with respect to the driver, and with the gear apparatus offsetting the head at an angle of 17° from a longitudinal axis of the driver. When the 17° offset is combined with the ability of the head to be moved among a plurality of positions, the operative location of the head from where a nut is driven can be widely varied to reach numerous remote positions.

Such machinery has not, however, been without limitation. While such machinery is desired to provide consistent levels of torque to the fasteners it drives, such machinery generally has provided undesirably inconsistent levels of torque to nuts depending upon the specific position of the head. Such inconsistent torque levels can result from many factors, including mechanical backlash among cooperative components, the cascading of tolerances in structures resulting in the misalignment of various components, as well as other factors. It is thus desired to provide an improved fastener driving machine that overcomes the problems associated with other such machinery. Such a fastener driving machine preferably would include a driver and a head, with the head being indexable among a plurality of positions, and with the machine providing consistent levels of torque to fasteners independent of the position of the head. Such a machine may also include an apparatus for offsetting from the driver the range of motion of the head without affecting the ability of the machine to deliver consistent levels of torque independent of the position of the head.

SUMMARY OF THE INVENTION

An improved fastener driving machine and related method meet these and other needs. An improved fastener driving machine includes a driver, a support, a gear mechanism, an indexing apparatus, and a head. The head is movable among a plurality of position with respect to the driver. The machine is advantageously structured to provide a substantially constant level of torque to a delivery point on the head independent of the position of the head with respect to the driver. The gear mechanism and the indexing apparatus are both disposed on the support, with the result that the mechanical operations of the gear mechanism are separate from the mechanical operation of the indexing apparatus. The indexing apparatus includes a number of tapered first teeth and a number of tapered second teeth that are securable to one another in a number of configurations to permit the head to be movably indexed to a number of positions with respect to the driver. The first and second teeth are biased together, and the indexing apparatus additionally includes a lock that locks the first and second teeth into engagement. An improved method is also disclosed.

Accordingly, an aspect of the present invention is to provide an improved fastener driving machine that has a movable head and that is able to provide substantially constant levels of torque independent of the position of the head.

Another aspect of the present invention is to provide an improved fastener driving machine having a driver, an indexing apparatus, and a head, with the indexing apparatus permitting the head to be movable among a plurality of positions with respect to the driver, and with the machine providing substantially constant levels of torque to a delivery point on the driver independent of the position of head with respect to the driver.

Another aspect of the present invention is to provide an improved fastener driving machine having an indexing apparatus that permits a head to be movable among a plurality of positions with respect to a driver, with the indexing apparatus including a number of first teeth and a number of second teeth, the first and second teeth being cooperatively tapered and engageable with one another.

Another aspect of the present invention is to provide an improved fastener driving machine having a driver, a support, a gear mechanism, an indexing apparatus, and a head, with the gear mechanism and the indexing apparatus both being disposed on the support, and with the support being disposed on the driver, with the operations of the gear mechanism being generally mechanically independent of the operations of the indexing apparatus.

Another aspect of the present invention is to provide an improved method of transmitting mechanical effort between a driver and a delivery point, with the delivery point being movable among a plurality of positions with respect to the driver, and with the mechanical effort at the delivery point being of a torque that corresponds substantially consistently with the torque supplied by the driver.

These and other aspects of the present invention are provided by an improved a machine, the general nature of which can be stated as including a driver structured to provide mechanical effort up to a given level of torque and a transmission apparatus. The transmission apparatus has a gear mechanism, a support, an indexing apparatus, and a head, and is structured to transmit the mechanical effort between the driver and a delivery point defined on the head. The gear mechanism is disposed on the support. The indexing apparatus includes a first portion and a second portion, with the first and second portions being biased toward one another. The first portion includes a plurality of first teeth disposed on the support, and the second portion includes a plurality of second teeth disposed on the head. The first and second teeth extend in a direction generally parallel with the direction of the bias of the first and second teeth. The first and second teeth are inter-engageable with one another in a plurality of configurations to permit the head to be movable with respect to the support among a plurality of positions, whereby the torque supplied at the delivery point corresponds substantially consistently with the given level of torque independent of the position of the head with respect to the driver.

Another aspect of the present invention is to provide an improved transmission apparatus for transmitting mechanical effort between a driver and a delivery point, with the driver being structured to provide the mechanical effort at up to a given level of torque, in which the general nature of the transmission apparatus can be stated as including a gear mechanism, a support, an indexing apparatus, and a head. The delivery point is defined on the head. The gear mechanism is disposed on the support. The indexing apparatus includes a first portion and a second portion, with the first and second portions being biased toward one another. The first portion includes a plurality of first teeth disposed on the support, and the second portion includes a plurality of second teeth disposed on the head. The first and second teeth extend in a direction generally parallel with the direction of the bias of the first and second teeth. The first and second teeth are inter-engageable with one another in a plurality of configurations to permit the head to be movable with respect to the support among a plurality of positions, whereby the transmission apparatus is structured such that the torque supplied at the delivery point corresponds substantially consistently with the torque of the mechanical effort supplied by the driver independent of the position of the head with respect to the driver.

Another aspect of the present invention is to provide an improved apparatus for enabling a delivery point to be moved with respect to a driver while permitting the transmission of mechanical effort between the driver and the delivery point, with the driver being structured to provide the mechanical effort at up to a given level of torque, in which the general nature of the apparatus can be stated as including a support structured to be disposed on the driver, an indexing apparatus, and a head. The delivery point is defined on the head. The indexing apparatus includes a number of first teeth and a number of second teeth, with the first and second teeth being cooperatively tapered. The first teeth and the second teeth are biased toward one another and extend in a direction generally parallel with the direction of the bias. The first teeth are disposed on the support, and the second tapered teeth are disposed on the head. The first and second teeth are inter-engageable with one another in a plurality of configurations to permit the head to be movable with respect to the support among a plurality of positions, whereby the apparatus is structured such that the torque supplied at the delivery point corresponds substantially consistently with the torque of the mechanical effort supplied by the driver independent of the position of the head.

Another aspect of the present invention is to provide an improved a method of transmitting mechanical effort between a driver and a delivery point, with the driver providing the mechanical effort at up to a given level of torque, and with the delivery point being movable among a plurality of positions with respect to the driver, in which the general nature of the method can be stated as including supplying the mechanical effort at the delivery point at a torque that corresponds substantially consistently with the given level of torque independent of the position of the delivery point with respect to the driver. The general nature of said supplying can be stated as including operatively disposing a gear mechanism between the driver and the delivery point, supporting the gear mechanism on a support, providing an indexing apparatus having a first portion and a second portion, affixing the first portion to the support, biasing a number of tapered first teeth of the first portion and a number of tapered second teeth of the second portion into engagement with one another, and securing the second portion to the first portion in one of a plurality of configurations to secure the delivery point in one of the plurality of positions with respect to the driver.

BRIEF DESCRIPTION OF THE DRAWINGS

A further understanding of the invention can be gained from the following Description of the Preferred Embodiments when read in conjunction with the accompanying drawings in which.

Similar numerals refer to similar parts throughout the specification.

DETAILED DESCRIPTION OF PREFERRED EMBODIMENTS

The expression "a number of" and variations thereof shall refer broadly to ant non-zero quantity including a quantity of one.

As used herein, the expression "corresponding" and variations thereof shall refer broadly to a relationship that is fixed, constant, and/or is ascertained with reasonable certainty.

As used herein, the expression "taper" and variations thereof shall refer broadly to a feature that results in the varying in an understood fashion of a related dimension, and can include linear or arcuate portions and combinations thereof.

As used herein, the expression "oblique" and variations thereof shall refer broadly relationship that is neither perpendicular nor parallel.

As used herein, the expression "mechanical effort" and variations thereof shall refer broadly to any and/or all of mechanical power, mechanical energy, and torque, both static and dynamic.

As used herein, the expression "bearing" and variations thereof shall refer broadly to any type of support system that resists friction between a pair of components yet permits movement therebetween, and expressly can includes ball bearings, roller bearings, fluid bearings, bushings, and other types of systems.

Figure 1:
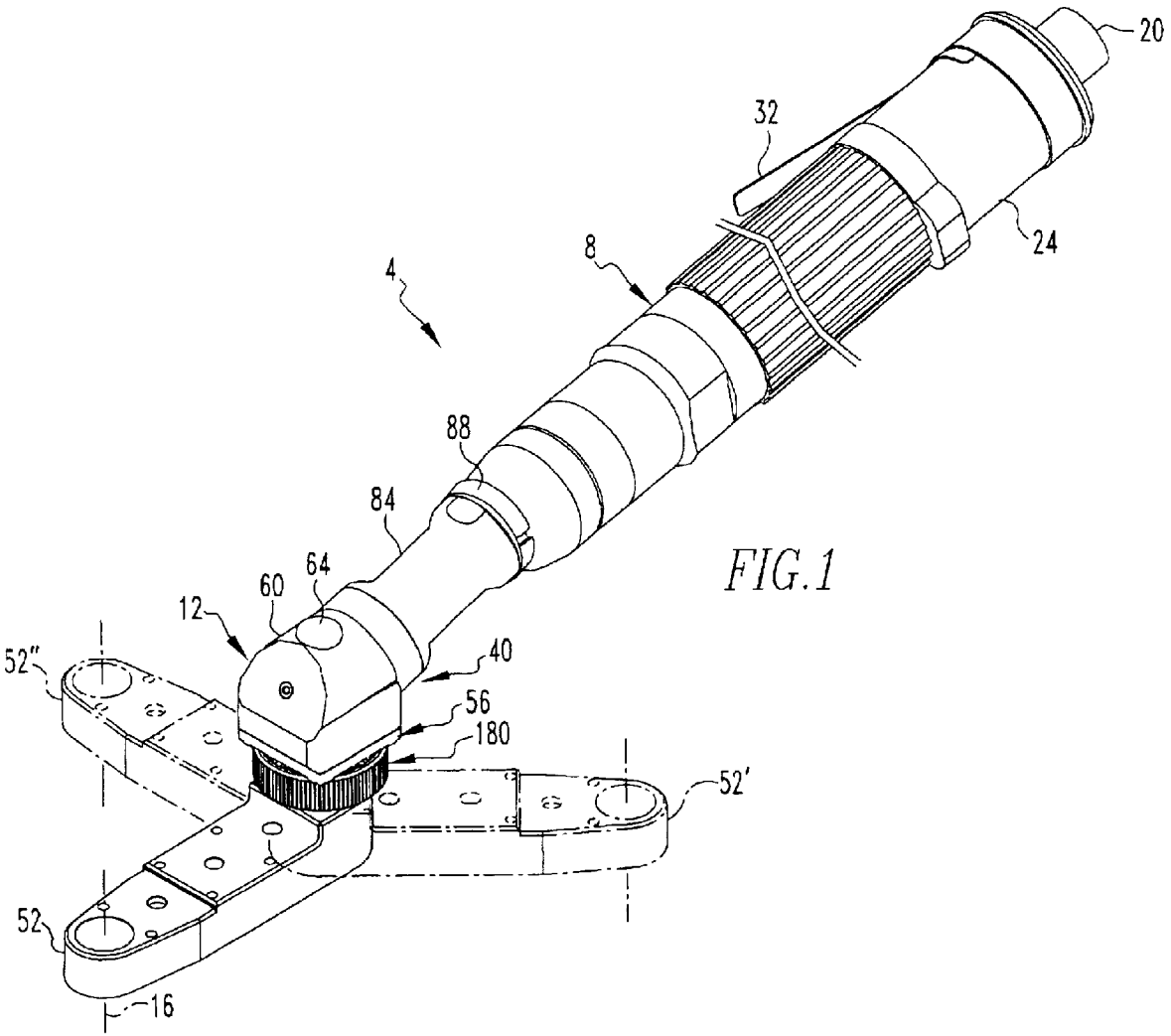
FIG. 1 is a perspective view of an improved fastener driving machine in accordance with a first embodiment of the present invention.
Figure 2:
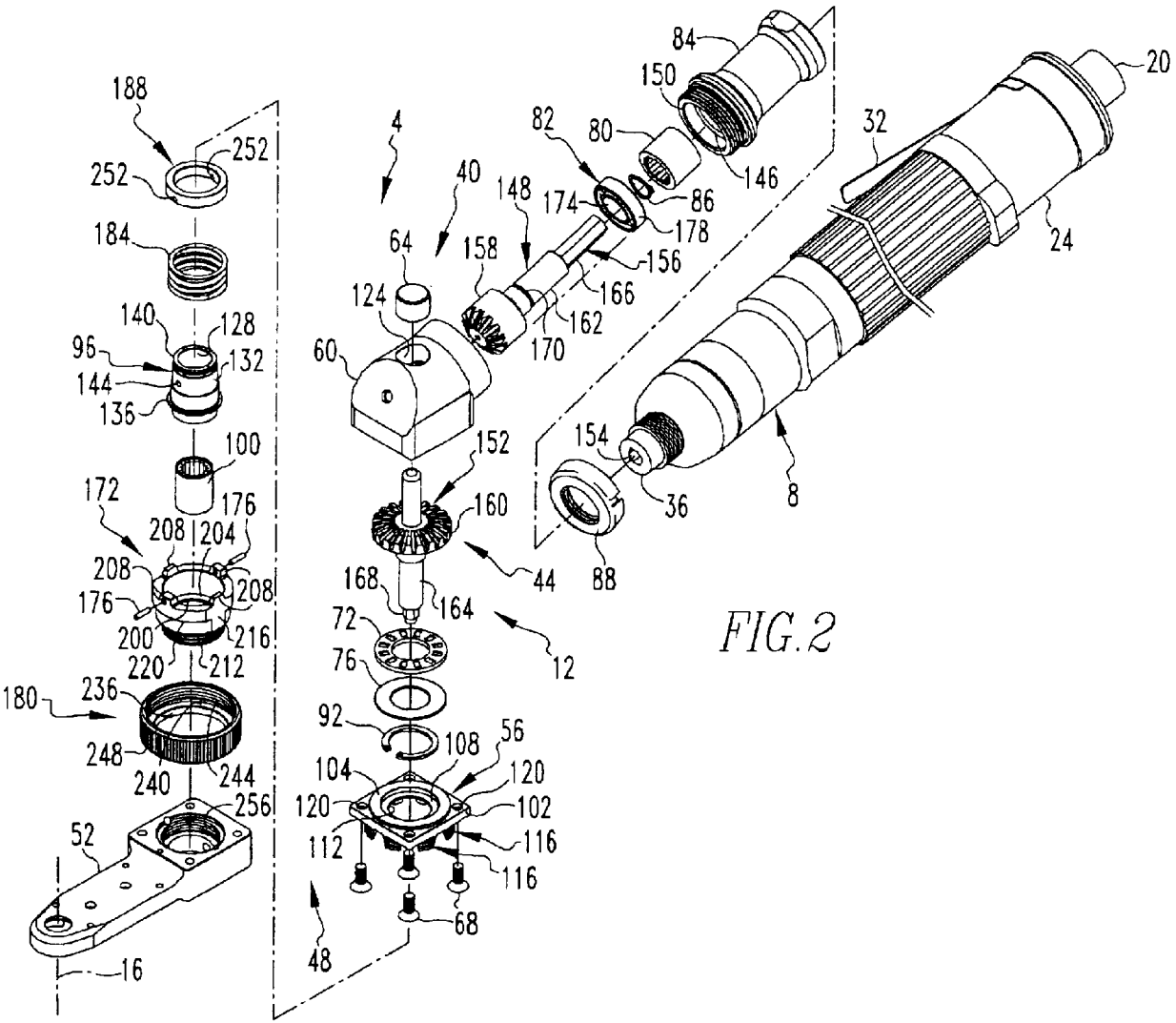
FIG. 2 is an exploded perspective view of the first embodiment.

An improved fastener driving machine 4 in accordance with a first embodiment of the present invention is indicated generally in FIGS. 1 and 2. The machine 4 can be employed in various applications, one of which is an application for the driving, i.e., rotating, of threaded fasteners (not shown) to a given level of torque. The machine 4 could, however, be used in other applications without limitation.

The machine 4 can be broadly described as including a driver 8 and a transmission apparatus 12, with the transmission apparatus 12 including a delivery point represented by an axis) 16 that is movable among a plurality of positions with respect to the driver 8, two of which are indicated at the numerals 52' and 52" in FIG. 1. As will be set forth in greater detail below, the machine is advantageously configured to deliver a constant level of torque to the delivery point 16 independent of the position of the delivery point 16 with respect to the driver 8.

As can be seen in FIG. 2, the driver 8 includes a nipple 20, a casing 24, a trigger 32, and a tip 36. The nipple 20 is configured to receive pneumatic power from a source of compressed air (not shown) to permit the driver 8 to provide mechanical effort. The casing 24 encloses a motor and a clutch, with the motor converting the pneumatic power into the mechanical effort, and with the clutch transferring the mechanical effort to the tip 36 until a specified level of torque is achieved. The level of torque often can be adjust for different conditions. The trigger 32 controls the creation of mechanical effort.

The transmission apparatus 12 can be broadly stated to include a support assembly 40, a gear mechanism 44, an indexing apparatus 48, and a head 52. The delivery point 16 is defined on the head 52, and the transmission apparatus 12 transfers the mechanical effort from the driver 8 to the delivery point 16. In the depicted embodiment the support assembly 40 is mountable on the tip 36 of the driver 8, but it is understood that in other applications the support assembly 40 need not be disposed on the driver 8, and rather can be remote therefrom.

The support assembly 40 can generally be stated as including a support 56, a housing 60, a close end radial bearing 64, a number of connectors 68 which are depicted herein as screws, a thrust bearing 72, a thrust race 76, a first radial bearing 80, a pinion thrust bearing 82, a pinion clip 86, an extension nipple 84, a jam nut 88, a clip 92, a guide sleeve 96, and a second radial bearing 100. It is understood that a support assembly 40 can be of other configurations than that depicted and described herein without departing from the concept of the present invention.

The exemplary support 56 includes a plate 102, an annular shoulder 104, a first counterbore shelf 108, a central bore 112, a number of first teeth 116, and a number of connector holes 120. The shoulder 104 protrudes outwardly from one surface of the plate 102, and the first counterbore shelf 108 is formed in the plate 102 and is concentric with the shoulder 104. The central bore 102 extends fully through the plate 102 and is also concentric with the shoulder 104. The connector holes 120 can receive the connectors 68 therethrough to affix together the housing 60 and the support 56. The first teeth 116 are affixed to a second surface of the plate 102 opposite the shoulder 104, but as will be described in greater detail below, the first teeth 116 are considered to be a part of the indexing apparatus 48.

The housing 60 includes a seat 124 formed therein within which the close end radial bearing 64 is disposed. The housing 60, being attached to the support 56 with the connectors 68, retains the close end bearing 64 in a fixed position with respect to the support 56.

The thrust race 76 is disposed on the shoulder 104, and the thrust bearing 72 is disposed on the thrust race 76. The thrust bearing 72 is rotatable on the thrust race 76 and provides longitudinal support to the gear mechanism 44, as will be described in greater detail below.

The guide sleeve 96 is a generally annular structure that includes a cylindrical thru-bore 128, an arcuate outer surface 132, an annular ridge 136, a groove 140, and one or more disassembly holes 144. The second radial bearing 100 is receivable in the thru-bore 128 and, as will be set forth in greater detail below, provides radial support to the gear mechanism 44. The end of the guide sleeve 96 on which the groove 140 is formed is receivable in the central bore 112 of the support 56, and the clip 92 is receivable in the groove 140. The outer surface 132 in the vicinity of the groove 140 is machined to have a close tolerance with the central bore 112.

The gear mechanism 44 includes a pinion gear 148 and a gear member 152 that are cooperable with one another. The pinion gear 148 includes pinion head 158 and an axially extending pinion shank 156. The pinion shank 156 includes a cylindrical pinion shaft 162 and a driven end 166. The driven end 166 is of an exemplary hexagonal cross section and is cooperable with a correspondingly shaped receptacle 154 disposed at the tip 36 of the driver 8. The pinion shaft 162 includes a pinion groove 170 formed thereon that is cooperable with the pinion clip 86.

The pinion gear 148 also includes an annular shelf (not explicitly depicted) formed on the pinion head 158 adjacent the pinion shaft 162. The pinion thrust bearing 82 includes an inner race 174 and an outer race 178 between which are disposed a plurality of balls. The pinion shank 156 is receivable through the central bore of the inner race 174 of the pinion thrust bearing 82, and the inner race is disposed against the shelf of the pinion gear 148. The shelf is configured to be disposed against the inner race 174 and to provide clearance between the outer race 178 and the pinion head 158 to permit the pinion gear 148 to be rotatably supported on the pinion thrust bearing 82. The pinion clip 86 is received on the pinion groove 170 to retain the inner race 174 between the pinion clip 86 and the shelf.

The first radial bearing 80 is received within a central region of the extension nipple 84. The pinion shaft 162 of the pinion gear 148 is then rotatably received through the first radial bearing 80. In so doing, the pinion thrust bearing 82 is pressed into a first end 150 of the extension nipple 84 until the outer race 178 is disposed against a counterbore 146 formed on the interior of the extension nipple 84. The pinion thrust bearing 82 provides radial support to the pinion gear 148, and the pinion thrust bearing 82 being supportingly disposed between the shelf on the pinion gear 148 and the counterbore 146 on the extension nipple 84 resists axial movement of the pinion gear 148 in a direction away from the gear member 152. The first radial bearing 80 provides additional radial support to the pinion gear 148.

The gear member 152 includes a bevel gear 160 and a shaft 164 that are coaxially aligned with one another. The shaft 164 of the gear member 152 includes a protrusion 168 extending axially therefrom. While the exemplary protrusion 168 is depicted herein as being of a hexagonal cross section, it is noted that the protrusion may be of other configurations without departing from the concept of the present invention.

The bevel gear 160 is rotatably disposed on the thrust bearing 72, whereby the thrust bearing 72 provides longitudinal support of the gear member 152. The portion of the shaft 164 that extends generally between the bevel gear 160 and the protrusion 168 is rotatably received in the second radial bearing 100. As such, the second radial bearing 100 provides radial support to the shaft 164. The portion of the shaft 164 opposite the protrusion 168 is rotatably received in the close end radial bearing 64 disposed on the housing 60. Accordingly, the close end radial bearing 64 can be said to provide radial support to the shaft 164 and thus to the gear mechanism 44.

The first radial bearing and the pinion thrust bearing 82 of the support 40 advantageously constrain the pinion gear 148 to rotational motion. Furthermore, the thrust bearing 72 and the second radial bearing 100 advantageously constrain the gear member 152 to rotational motion. By intermeshingly engaging the pinion gear 148 and the gear member 152, which are thusly constrained to rotational motion, mechanical effort is advantageously transmitted from the driver 8 to the protrusion 168 such that the torque at the protrusion 168 corresponds substantially consistently with the torque of the mechanical effort at the driver 8. In this regard, it is noted that friction and different gear ratios of the gear mechanism 44 alter the torque between the driver 8 and the protrusion 168 in a predictable fashion.

The support assembly 40 can be connected with the driver 8 and can be generally disposed thereon by receiving the jam nut 88 on the tip 36 of the driver 8, and by receiving the tip 36 in a cooperatively threaded first end of the extension nipple 84. A second end of the extension nipple 84 is threadably engageable with the housing 60. It is noted, however, that other connection and attachment methodologies may be employed without parting from the concept of the present invention.

It can be understood from the foregoing, therefore, that the gear mechanism 44 is securely operatively connected with the driver 8 by being securely disposed and supported on the support assembly 40 and particularly on the support 56 and the extension nipple 84. Such supporting of the gear mechanism 44 results in secure engagement of the pinion gear 148 with the gear member 152, and furthermore isolates the gear mechanism 44 from the first teeth 116. The movement of the protrusion 168 and the torque therefrom correspond closely with the movement and torque provided by the driver 8. In this regard, and as defined above, the expression "corresponds" refers to the fact that a certain amount of friction may exist in the movable components of the support assembly 40 and the gear mechanism 44, and such friction may cause a torque that resists the mechanical effort provided by the driver 8. Such torque is generally readily ascertainable, such that while the torque at the protrusion 168 may be slightly less than the torque of the driver 8 at the tip 36, it is understood that the relationship between the two torques is substantially constant, and thus is predictable.

The indexing apparatus 48 includes an indexing housing 172, a pair of pins 176, a lock ring 180, a spring 184, a stop, 188, and, as indicated above, the first teeth 116 affixed to the plate 102. As will be described in greater detail below, the indexing apparatus 48 permits the head 52 to be disposed in a number of configurations, i.e., positions, with respect to the support 56 and with respect to the driver 8. While the indexing apparatus 48 described below can be understood to permit the head 52 to rotate, it is understood that other configurations of the indexing apparatus 40 can be arranged to permit different types of motion of the head 52 without departing from the concept of the present invention.

Figure 10:
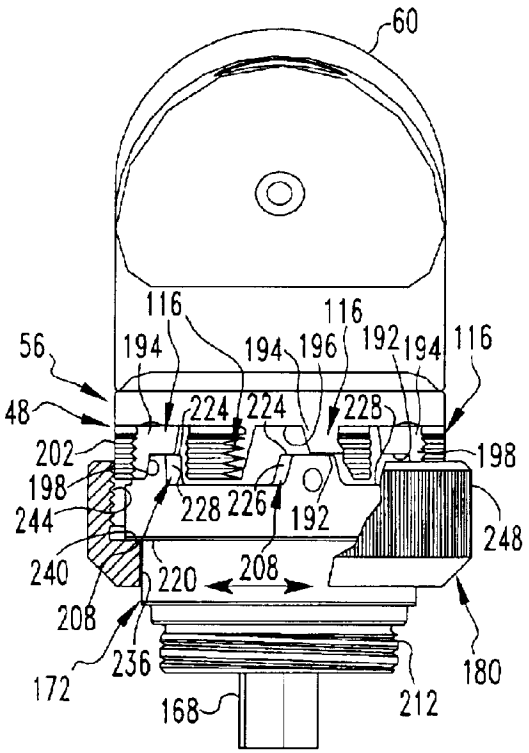
FIG. 10 is a view similar to FIG. 9, except depicting the second teeth being disengaged from the first teeth and being moved with respect thereto from one configuration to another.
Figure 9:
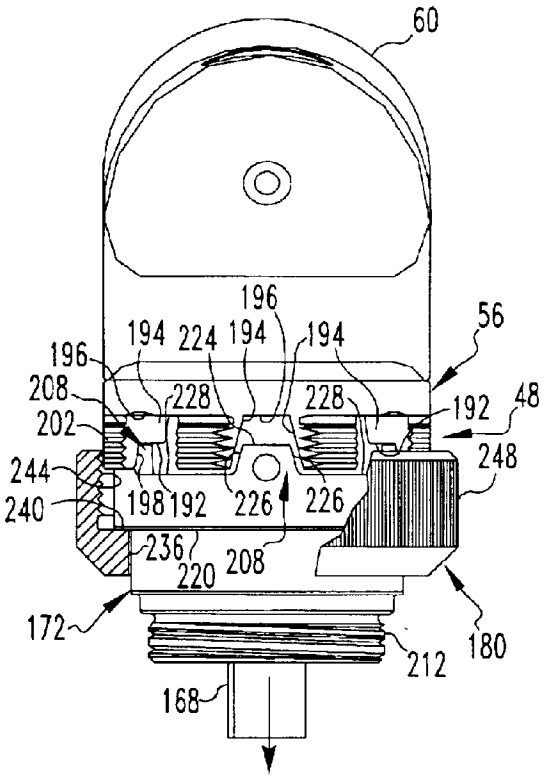
FIG. 9 is a view similar to FIG. 8, except depicting the lock ring unthreaded from the first teeth.
Figure 8:
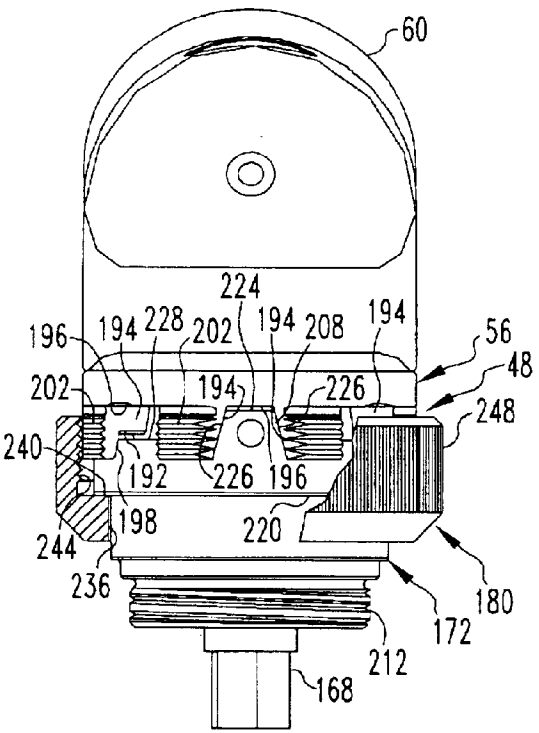
FIG. 8 is an elevational view, partially cut away, of a portion of the first embodiment depicting a number of first and second teeth engaged with one another and showing a lock ring threadably engaged with the first teeth.

As can be best understood from FIGS. 8–10, the first teeth 116 each include a first tip 192, a first root 196, a first taper 194, and a thread extension 198. The radially outermost surfaces of the first teeth 116 include external threading 202 that cooperates with the lock ring 180, as will be described in greater detail below.

The indexing housing 172 includes a central opening 200 extending therethrough and a second counterbore shelf 204 that is coaxial with the central opening 200. The indexing housing 172 further includes a number of second teeth 208 at a first end thereof and a threaded nipple 212 at a second end thereof. A pair of opposed flats 216 are formed on an outer surface of the indexing housing 172, and an annular lip 220 is additionally formed on the outer surface.

Each of the second teeth includes a second tip 224, a second root 228, and a second taper 226. An opposed pair of the second teeth 208 are formed with axially aligned pin holes 232 that are configured to receive the pins 176 therein.

The first teeth 116 can be said to form a first portion of the indexing apparatus 48, and the second teeth 208 can be said to form a second part of the indexing apparatus 48. In the exemplary embodiment of the present invention, the indexing apparatus 48 includes eight of the first teeth 116 evenly spaced about the plate 102, and further includes four of the second teeth 208 equally spaced about the indexing housing 172.

As can be understood from FIGS. 8–10, the first and second tapers 194 and 226 are cooperable with one another, meaning that in the exemplary embodiment presented herein they are oriented at complementary angles with respect to one another. The first and second teeth 116 and 208 are engageable with one another at eight different configurations, i.e., rotational positions, with respect to one another, of which three are shown in FIG. 1. The indexing apparatus 48 may, in other embodiments, be configured to provide different numbers of configurations and/or one or more specific configurations that are provided for use in specific circumstances.

The lock ring 180 is an annular member having a middle bore 236 extending therethrough and a third counterbore shelf 240 that is coaxial with the middle bore 236. The lock ring 180 additionally includes internal threading 244 and external knurling 248 opposite one another. The internal threading 244 is cooperable with the external threading 202 formed on the outer surfaces of the first teeth 116. The lock ring 180 and the first teeth 116 may, in other embodiments, be configured differently to provide different locking methodologies, such as by providing a bayonet connection or other types of connections therebetween.

The stop 188 is an annular member that can receive a portion of the guide sleeve 96 therethrough. The stop 188 includes a pair of axially aligned pin holes 252 that can receive the pins 176 therein. The stop 188 serves to retain the spring 184 in a loaded condition, such as a state of compression as is depicted herein.

The head 52 is an elongated member that includes a threaded cavity 256 generally opposite the delivery point 116. The head 52 includes a gear train or similar apparatus that operatively connects the protrusion 168 of the gear member 152 with the delivery point 116 in a fashion that transfers mechanical effort therebetween. The threaded nipple 212 of the indexing housing 172 is threadably receivable in the threaded cavity 256.

Figure 3A:
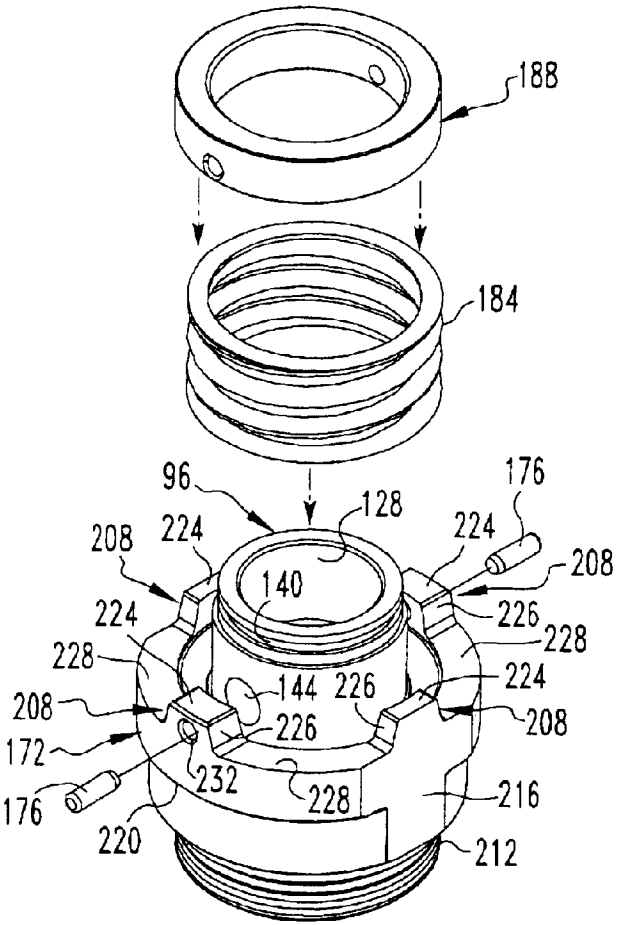
FIGS. 3–7 depict various steps in the assembly of the first embodiment.
Figure 3:
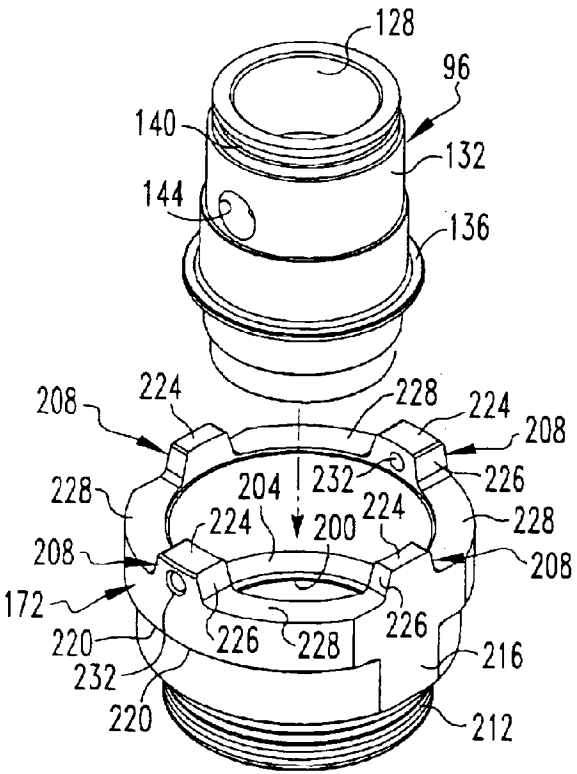

As indicated above, FIGS. 3–7 depict various steps in the assembly of the machine 4. As indicated above, the second radial bearing 100 is received in the thru-bore 128 of the guide sleeve 96. As is shown in FIG. 3, the ridge 136 of the guide sleeve 96 is initially received against the second counterbore shelf 204 of the indexing housing 172. A close tolerance exists between the central opening 200 and the portion of the guide sleeve 96 extending therethrough.

As can be seen in FIG. 3A, the spring 184 is then received against the ridge 136, and the stop 188 is received against the spring 184, with the stop 188 being employed to compress the spring 184 until the pin holes 252 of the stop 188 are generally aligned with the pin holes 232 of the second teeth 208. The pins 176 are then received in the pin holes 232 and 252 to retain the stop 188 in a fixed position with respect to the indexing housing 172 and to retain the spring 184 in a loaded condition, such as the depicted state of compression, between the stop 188 and the ridge 136. In other embodiments (not shown) the spring 184 potentially could be retained in a state of tension depending upon the configuration of the machine. As can be understood from FIG. 3A, the disassembly hole 144 of the guide sleeve 96 is aligned with the pin holes 232 and 252 in order to permit the pins 176 to be removed from the pin holes 232 and 252 upon disassembly of the indexing apparatus 48.

Figure 5:
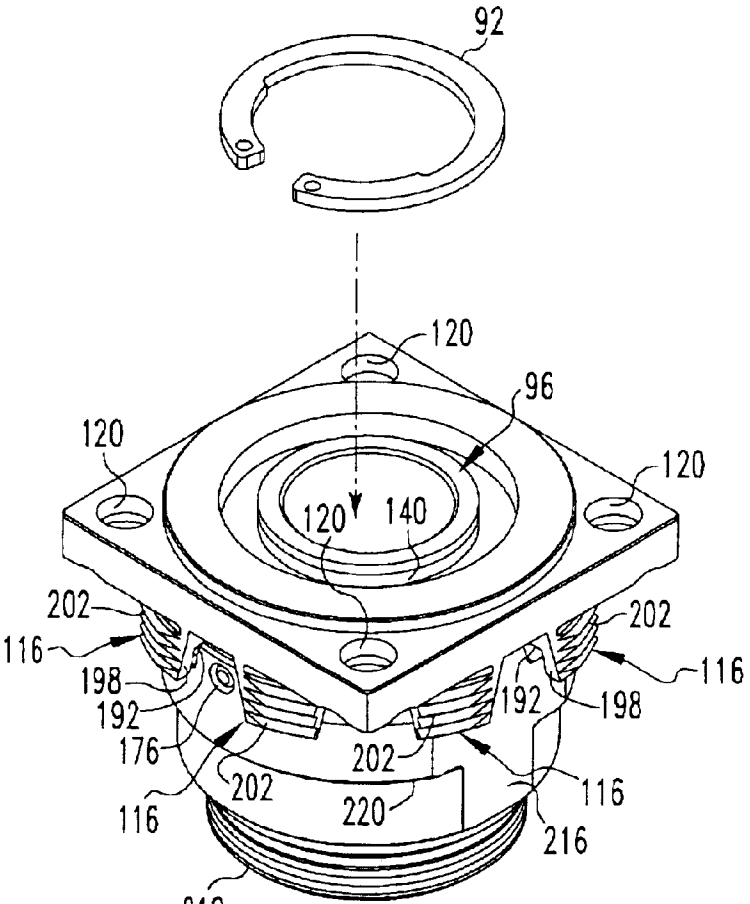
Figure 4:
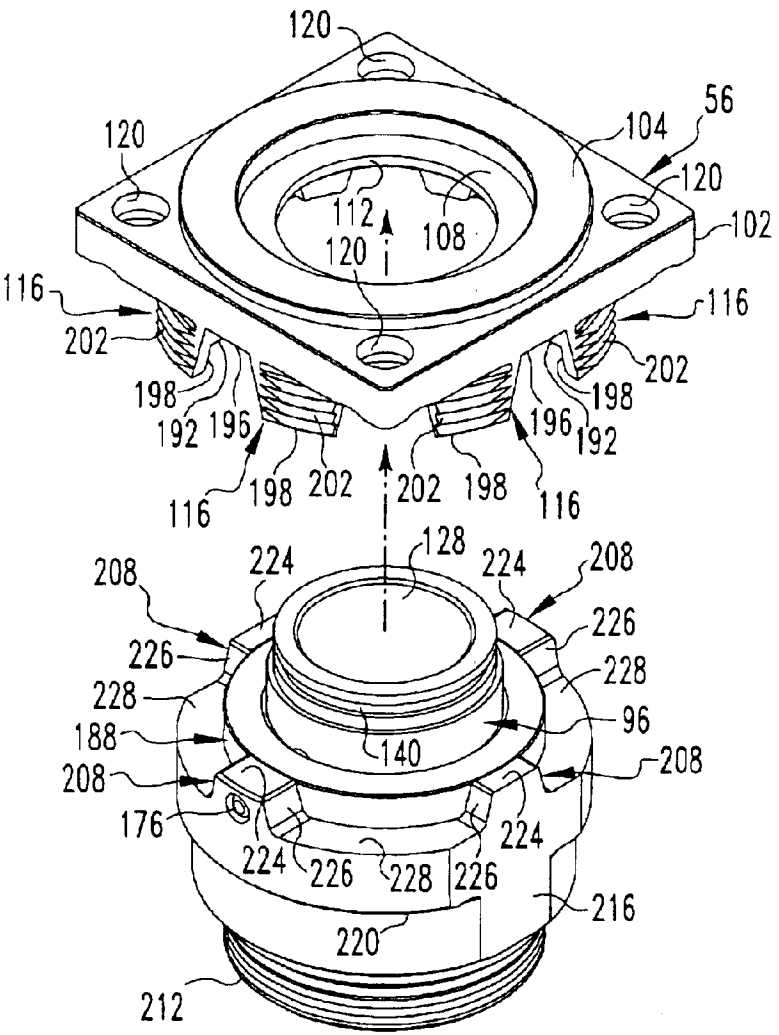

As can be understood from FIGS. 4 and 5, the portion of the guide sleeve 96 having the groove 140 is received through the central bore 112 of the support 56, and the clip 92 is received in the groove 140. In so doing, the spring 184 is compressed to an even greater degree to permit the groove 140 to be received through the central bore 112. Such further compression of the spring 184 results in the ridge 136 being spaced from the second counterbore shelf 204. The clip 92 is biased against the first counterbore shelf 108, and the guide sleeve 96 and the support 56 are biased together.

As can be understood from the foregoing, therefore, the spring 184 biases the first teeth 116 and the second teeth 208 toward one another. It also can be seen that the first and second tapers 194 and 226 are oriented at an angle that is oblique to the direction along which the first and second teeth 116 and 208, i.e., the first and second portions of the indexing apparatus 48, are biased toward one another. The oblique orientation can be seen particularly in FIGS. 8–10. Such an oblique orientation, when combined with the complementary configuration of the first and second tapers 194 and 226, results in the spring 184 biasing the first and second tapers 194 and 226 into tight engagement with one another in a fashion that resists movement of the indexing housing 172 with respect to the support 56 when the first and second teeth 116 and 208 are engaged with one another.

As can also be understood from the accompanying figures, particularly FIGS. 8–10, the first and second teeth 116 and 208 extend in a direction generally parallel with the direction of the bias of the first and second teeth 116 and 208 toward one another. In this regard, the first teeth 116 extend from the first roots 196 toward the thread extensions 198, and such direction is generally parallel with the direction along which the first and second teeth 116 and 208 are biased together. Similarly, the second teeth 208 extend from the second roots 228 toward the second tips 224, and such direction is likewise generally parallel with the direction along which the first and second teeth 116 and 208 are biased together. Such an arrangement is appropriate considering that the first and second teeth 116 and 208 travel with respect to one another along the direction of such bias and engage in such a fashion. Stated otherwise, the first and second teeth 116 and 208 extend in the direction in which they engage one another.

Figure 6:
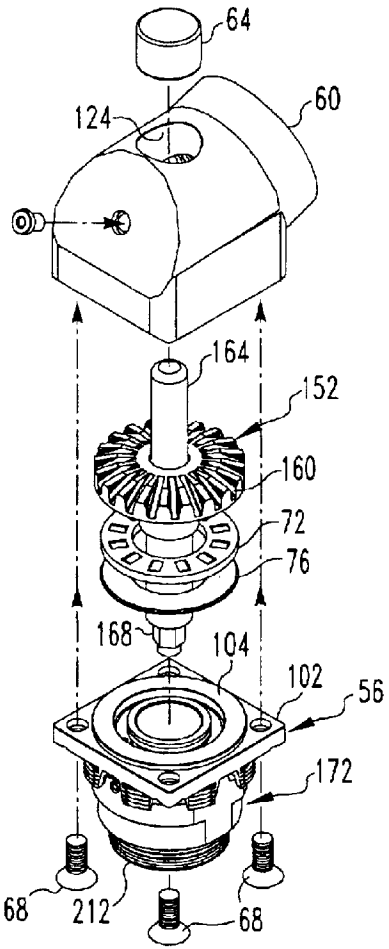

As can be understood from FIG. 6, the thrust race 76 is received against the shoulder 104, the thrust bearing 72 is disposed on the thrust race 76, and the bevel gear 160 is disposed against the thrust bearing 72. The portion of the shaft 164 extending from the bevel gear 160 through the protrusion 168 are received through the thru-bore 128 of the guide sleeve 96 and thus through the second radial bearing 100, whereby the protrusion 168 operatively engages the aforementioned gear train or other apparatus of the head 52.

The bevel gear 148 is then received in the housing 60 in inter-meshing relation with the bevel gear 160. The first radial bearing 80 and the pinion thrust bearing 82 providing both radial and longitudinal retention of the pinion gear 148 to retain the pinion gear 148 in a precise position and to permit only rotational motion of the pinion gear 148. The thrust bearing 72 provides longitudinal support to the gear member 152, and the second radial bearing 100 provides radial support to the shaft 162, whereby the bevel gear 160 is retained in a precise position and only rotational motion of the bevel gear 160 is permitted. It thus can be seen that the gear mechanism 44 is completely supported by the support assembly 40.

Figure 7:
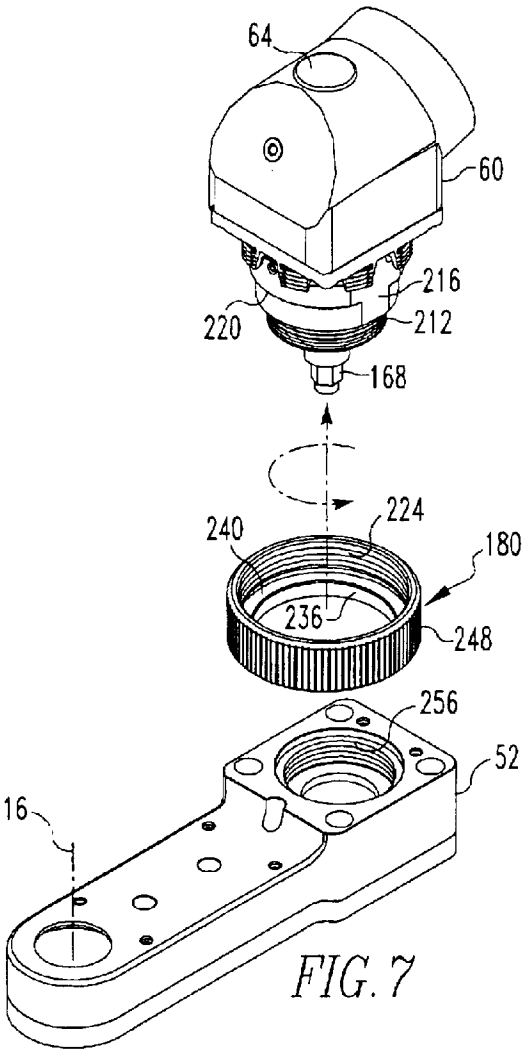

As can be understood from FIG. 7, the threaded nipple 212 is received through the middle bore 236 of the lock ring 180 and is threadably engaged with the threaded cavity 256 of the head 52. In this regard, a wrench may be applied to the flats 216 of the indexing housing 172 to effect such threadable engagement. As suggested above, the protrusion 168 becomes operatively engaged with the gear train or other apparatus (not shown) in the head 52 to operatively connect the protrusion 168 with the delivery point 16. The internal threading 244 of the lock ring 180 is then threadably engaged with the external threading 202 of the first teeth 116, which causes the second teeth 208, i.e., the second portion of the indexing apparatus 48, to be interposed between the first teeth 116, i.e., the first portion of the indexing apparatus 48, and the third counterbore shelf 240 of the lock ring 180. This also locks together the first and second portions of the indexing apparatus 48 in one of the different configurations thereof.

As can be understood from FIGS. 8–10, when the fast and second teeth 116 and 208 are secured together, the first and second tapers 194 and 226 abut one another. Such abutment resists relative rotation or other movement between the support 56 and the indexing housing 172. In such a secured position, it can further be seen that the first tips 192 are spaced slightly from the second roots 228, and the second tips 224 are spaced slightly from the first roots 196. Accordingly, substantially only the first and second tapers 194 and 226 engage one another, and such engagement, being oblique to the direction of bias of the support 56 and the indexing housing 172 toward one another, resists any type of movement of the indexing housing 172 with respect to the support 56.

The oblique angle at which the first and second tapers 194 and 226 engage one another may be selected such that the frictional forces therebetween provided by the bias of the first and second portions toward one another is itself substantially sufficient to resist disengagement of the indexing housing 172 from the support 56. The application of the lock ring 180, whereby the third counterbore shelf 240 engages the lip 220 of the indexing housing 172 to engage the first and second teeth 116 and 208 together, further resists movement of the indexing housing 172 with respect to the support 56, but may be optional depending upon the configuration of the indexing housing 172 and the support 56.

As can be best understood from FIG. 8, the thread extensions 198 protrude outwardly from the first teeth 116 past the first tips 192. When the first and second teeth 116 and 208 are engaged with one another, the thread extensions 198 slightly overlap the indexing housing 172 beyond the second roots 228 of the second teeth 208. The thread extensions 198 provide a relatively larger threaded region on the first teeth 116 that is threadably cooperable with the internal threading 224 of the lock ring 180 without correspondingly increasing the depth of engagement of the first and second teeth 116 and 208 with one another. This has the advantageous result that the first and second teeth 116 and 208 can be disengaged from one another by separating them less than the entire height of the threaded engagement between the first teeth 116 and the lock ring 180, which advantageously requires less effort in overcoming the bias provided by the spring 184. The arrangement also provides for a compact mechanism.

In order to adjust the head 56 from one configuration to another, that is, to move the delivery point 116 from one position to another, the lock ring 180 is unthreaded from the first teeth 116 (FIG. 9). The indexing housing 172 and the support 56 are then pulled apart from one another to disengage the first and second teeth 116 and 208 from one another sufficient for the first and second tips 192 and 224 to clear one another (FIG. 10), and the indexing housing 172 is rotated with respect to the support 56 or vice-versa until a desired position of the head 52 is achieved. In disengaging the first and second teeth 116 and 208 from one another, a technician must overcome the bias provided by the spring 184 in pulling apart the indexing housing 172 and the support 56.

When the head 52 is in a desirable position, at least one of the support 56 and the indexing housing 172 is released, thereby permitting the spring 184 to bias the first and second teeth 106 and 208 together in the desired position. The lock ring 180 is then threaded onto the external threading 202 of the first teeth 116.

From the foregoing, it thus can be seen that the mechanical functions of the gear mechanism 44 are substantially kept separate from the mechanical operations of the indexing apparatus 48. As such, this advantageously avoids the cascading of tolerances and backlash between gearing and indexing functions that have plagued previous fastener driving machinery. Also, the use of the tapered first and second teeth 116 and 208, along with the locking fiction provided by the lock ring 180, is employed to secure the indexing apparatus 48, and thus the head 52, in any of a variety of configurations, which permits the delivery point 16 to correspondingly be disposed in a number of positions. If the first and second tapers 194 and 226 are machined to reasonable tolerances, the engagement of the first and second tapers 194 and 226 resists movement of the indexing housing 172 with respect to the support 56. Moreover, the movement of the indexing housing 172 to the various rotational positions with respect to the support 56 will not affect the mechanics of the delivery of mechanical effort between the driver 8 and the delivery point 16 since such delivery, being provided by the portion of the shaft 164 that extends through the indexing apparatus 48, operates substantially independently of the indexing apparatus 48. As such, the torque at the delivery point 16 bears a substantially constant relationship to the torque provided by the driver 8 independent of the position of the head 52 with respect to the driver 8.

In this regard, again, while the torque provided at the delivery point 16 may not be precisely the same as the torque provided by the driver 8 due to the gear ratios of the gear mechanism 44 and the head 52, and also due to the effects of friction and the like within the transmission apparatus 12, the torque at the delivery point 16 nevertheless is of a constant or understood value independent of the position of the head 52 with respect to the driver 8. If the driver 8 produces mechanical effort up to a given constant level of torque, the torque at the delivery point 16 will accordingly bear a substantially constant, i.e., understood, relationship to the torque of the driver 8 independent of the position of the delivery point 16 with respect to the driver 8.

Figure 11:
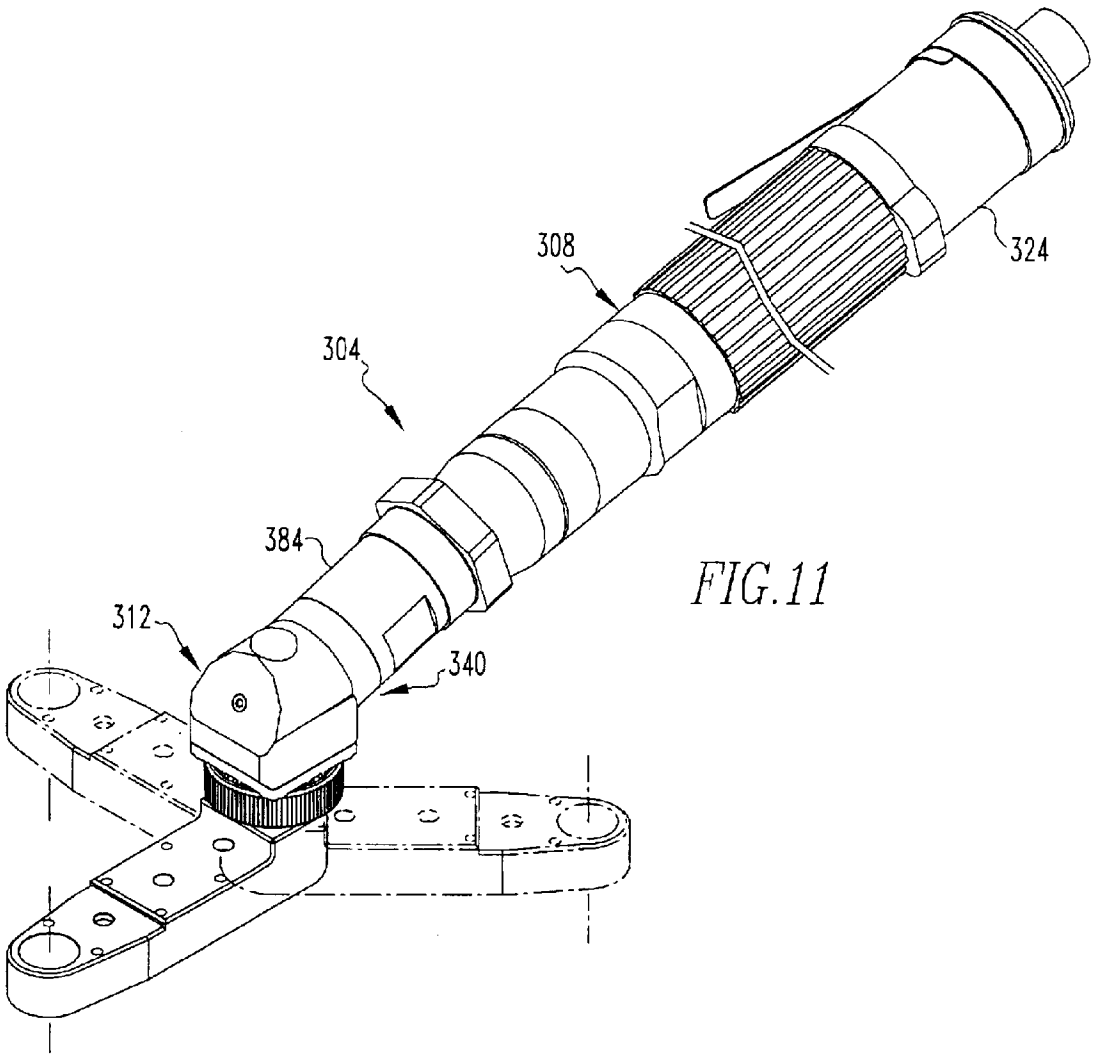
FIG. 11 is a perspective view of an improved fastener driving machine in accordance with a second embodiment of the present invention.
Figure 12:
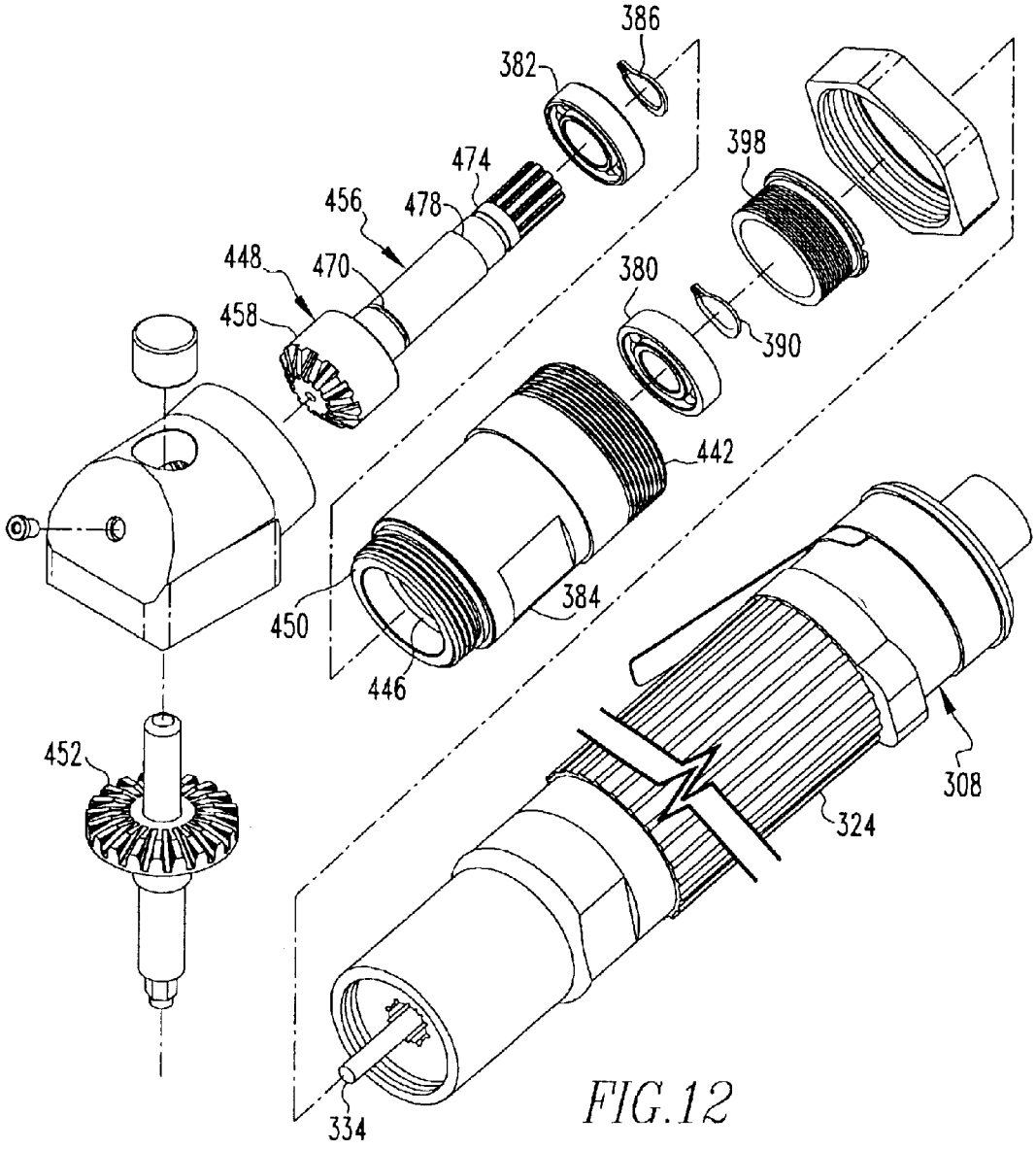
FIG. 12 is an exploded perspective view of a portion of the second embodiment.

An improved fastener driving machine 304 in accordance with a second embodiment is shown in FIG. 11. The machine 304 is similar to the machine 4 except that it includes a driver 308 that is suited to high torque applications, and the driver 308 thus includes a pin 334 that operates a valve within the driver 308.

In order for the driver 308 to produce mechanical effort, the pin 334 must be depressed into the housing 324 of the driver 308. The machine 304 thus includes a transmission apparatus 312 that provides such function.

Specifically, the pinion gear 448 engages and depresses the pin 334. Since the force required to perform such depression can be significant, the support 340 is configure to resist movement of the pinion gear away from the driver 308 and toward the gear member 452. In this regard, it is understood that significant axial forces on the pinion gear 448 in a direction toward the gear member 452 may have a tendency to cause binding between the pinion gear 448 and the gear member 452.

The pinion gear 448 includes a first groove 470, a second groove 474, and an annular ledge 478 formed thereon. The support 340 includes a first bearing 382 and a second bearing 380 that supportingly extend between the pinion gear 448 and the extension nipple 384. The support 340 further includes a first clip 386 and a second clip 390 that are receivable in the first and second grooves 470 and 474, respectively, to retain the first and second bearings 382 and 380 on the pinion gear 448. The first bearing 382 is disposed between the first clip 386 and the shelf (not explicitly depicted) disposed between the pinion head 458 and the pinion shank 456 of the pinion gear 448. The second bearing 380 is disposed between the second clip 390 and the ledge 478.

After assembly, the first bearing 382 is disposed against a first counterbore 446 formed on the interior of the extension nipple 484 near a first end 450 of the extension nipple 484. The second bearing 380 is interposed between a second counterbore (not explicitly depicted herein) formed on the interior of the extension nipple 484 near a second end 442 thereof and a threaded jam plug 398 that is threadably received in the second end 442.

The reception of the first and second bearings 382 and 380 against the first counterbore 446 and the jam plug 398, respectively, resists movement of the pinion gear 448 in a direction away from the gear member 452 and toward the driver 308. The first and second bearings 382 and 380 thus can be said to be supportingly disposed between the pinion gear 448 and the extension nipple 484.

The reception of the second bearing 380 against the second counterbore (not explicitly depicted herein) resists movement of the pinion gear 448 in a direction toward the gear member 452 and away from the driver 308. The second bearing 380 thus can be said to be supportingly disposed between the driver 308 and the extension nipple 484 due to the force of the pin 334 applied to the pinion gear 448 and transferred from the second clip 390 to an inner race of the second gear 380 that is disposed in the second counterbore of the extension nipple 484. The machine 304 thus resists binding between the pinion gear 448 and the gear member 452 despite the forces imparted by the pin 334.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A machine comprising:

a driver structured to provide mechanical effort up to a given level of torque;

a transmission apparatus having a gear mechanism, a support, an indexing apparatus, and a head, the transmission apparatus being structured to transmit the mechanical effort between the driver and a delivery point defined on the head;

the gear mechanism being disposed on the support;

the indexing apparatus including a first portion and a second portion;

the first and second portions being biased toward one another;

the first portion including a plurality of first teeth disposed on the support;

the second portion including a plurality of second teeth disposed on the head;

the first and second teeth extending in a direction generally parallel with the direction of the bias of the first and second teeth; and the first and second teeth being inter-engageable with one another in a plurality of configurations to permit the head to be movable with respect to the support among a plurality of positions, whereby the torque supplied at the delivery point corresponds substantially consistently with the given level of torque independent of the position of the head with respect to the driver.

2. The machine of claim 1, wherein the first and second teeth are cooperatively tapered.

3. The machine of claim 2, wherein the first and second teeth each include a tip and a root; and the tips of the fist teeth generally are spaced from the roots of the second teeth, and the tips of the second teeth generally are spaced from the roots of the first teeth, when the first and second portions are inter-engaged with one another.

4. The machine of claim 2, wherein the first and second teeth include tapers that are oriented generally oblique to the direction of the bias of the first and second portions.

5. The machine of claim 1, wherein at least a portion of the gear mechanism extends through at least a portion of each of the support, the first portion, and the second portion to operatively engage the head.

6. The machine of claim 5, wherein the gear mechanism includes a gear member, the gear member including the at least portion of the gear mechanism;

the gear member being rotatable about an axis;

the support including a first bearing that longitudinally supports the gear member; and the support including a second bearing that radially supports the at least portion of the gear mechanism.

7. The machine of claim 6, wherein the transmission apparatus includes a guide sleeve;

the guide sleeve extending through the first and second portions; and the second bearing being disposed on the guide sleeve.

8. The machine of claim 7, wherein the guide sleeve and one of the first portion and the second portion are biased together.

9. The machine of claim 6, wherein the gear mechanism further includes a pinion gear;

the pinion gear and the gear member being intermeshed with one another;

the pinion gear being rotatably disposed on the support; and the support resisting movement of the pinion gear in a direction away from the gear member.

10. The machine of claim 9, wherein the support includes a nipple and a bearing;

the nipple being supportingly disposed between the pinion gear and the driver; and the bearing being supportingly disposed between the pinion gear and the nipple to resist movement of the pinion gear in the direction away from the gear member.

11. The machine of claim 9, wherein the support resists movement of the pinion gear in a direction toward the gear member.

12. The machine of claim 11, wherein the support includes a nipple, a first bearing, and a second bearing;

the nipple being supportingly disposed between the pinion gear and the driver;

the first bearing being supportingly disposed between the pinion gear and the nipple to resist movement of the pinion gear in the direction away from the gear member; and the second bearing being supportingly disposed between the driver and the nipple to resist movement of the pinion gear in the direction toward the gear member.

13. The machine of claim 1, wherein the indexing apparatus further includes a lock that locks the first and second portions together.

14. The machine of claim 13, wherein the lock includes a threaded member;

the second portion being disposed generally between the first portion and the threaded member; and the first portion being threadably cooperable with the threaded member.

15. The machine of claim 14, wherein the first teeth are threaded and are threadably cooperable with the threaded member.

16. The machine of claim 13, wherein the second portion includes a lip that is spaced from the head; and the lock extending between the lip and the first portion.

17. A transmission apparatus for transmitting mechanical effort between a driver and a delivery point, the driver being structured to provide the mechanical effort at up to a given level of torque, the transmission apparatus comprising:

a gear mechanism;

a support;

an indexing apparatus;

a head, the delivery point being defined on the head;

the gear mechanism being disposed on the support;

the indexing apparatus including a first portion and a second portion;

the first and second portions being biased toward one another;

the first portion including a plurality of first teeth disposed on the support;

the second portion including a plurality of second teeth disposed on the head;

the first and second teeth extending in a direction generally parallel with the direction of the bias of the first and second teeth; and the first and second teeth being inter-engageable with one another in a plurality of configurations to permit the head to be movable with respect to the support among a plurality of positions, whereby the transmission apparatus is structured such that the torque supplied at the delivery point corresponds substantially consistently with the torque of the mechanical effort supplied by the driver independent of the position of the head with respect to the driver.

18. The transmission apparatus of claim 17, wherein at least one of the first and second teeth includes a taper.

19. The transmission apparatus of claim 18, wherein the first and second teeth are cooperatively tapered.

20. The transmission apparatus of claim 19, wherein the first and second teeth each include a tip and a root; and the tips of the first teeth generally being spaced from the roots of the second teeth, and the tips of the second teeth generally being spaced from the roots of the first teeth, when the first and second portions are inter-engaged with one another.

21. The transmission apparatus of claim 20, wherein the first and second teeth include tapers that are oriented generally oblique to the direction of the bias of the first and second portions.

22. The transmission apparatus of claim 17, wherein at least a portion of the gear mechanism extends through at least a portion of each of the support, the first portion, and the second portion to operatively engage the head.

23. The transmission apparatus of claim 22, wherein the gear mechanism includes a gear member, the gear member including the at least portion of the gear mechanism;

the gear member being rotatable about an axis;

the support including a first bearing that longitudinally supports the gear member; and the support including a second bearing that radially supports the at least portion of the gear mechanism.

24. The transmission apparatus of claim 23, wherein the transmission apparatus includes a guide sleeve;

the guide sleeve extending through the first and second portions; and the second bearing being disposed on the guide sleeve.

25. The transmission apparatus of claim 24, wherein the guide sleeve and one of the first portion and the second portion are biased together.

26. The transmission apparatus of claim 23, wherein the gear mechanism further includes a pinion gear;

the pinion gear and the gear member being intermeshed with one another;

the pinion gear being rotatably disposed on the support; and the support resisting movement of the pinion gear in a direction away from the gear member.

27. The transmission apparatus of claim 26, wherein the support includes a nipple and a bearing;

the nipple being supportingly disposed between the pinion gear and the driver; and the bearing being supportingly disposed between the pinion gear and the nipple to resist movement of the pinion gear in the direction away from the gear member.

28. The transmission apparatus of claim 26, wherein the support resists movement of the pinion gear in a direction toward the gear member.

29. The transmission apparatus of claim 28, wherein the support includes a nipple, a first bearing, and a second bearing;

the nipple being supportingly disposed between the pinion gear and the driver;

the first bearing being supportingly disposed between the pinion gear and the nipple to resist movement of the pinion gear in the direction away from the gear member; and the second bearing being supportingly disposed between the driver and the nipple to resist movement of the pinion gear in the direction toward the gear member.

30. The transmission apparatus of claim 17, wherein the indexing apparatus further includes a lock that locks the first and second portions together.

31. The transmission apparatus of claim 30, wherein the lock includes a threaded member;

the second portion being disposed generally between the first portion and the threaded member; and the first portion being threadably cooperable with the threaded member.

32. An apparatus for enabling a delivery point to be moved with respect to a driver while permitting the transmission of mechanical effort between the driver and the delivery point, the driver being structured to provide the mechanical effort at up to a given level of torque, the apparatus comprising:

a support structured to be disposed on the driver;

an indexing apparatus;

a head;

the delivery point being defined on the head;

the indexing apparatus including a number of first teeth and a number of second teeth, the first and second teeth being cooperatively tapered;

the first teeth and the second teeth being biased toward one another;

the first and second teeth extending in a direction generally parallel with the direction of the bias of the first and second teeth;

the first teeth being disposed on the support;

the second tapered teeth being disposed on the head; and the first and second teeth being inter-engageable with one another in a plurality of configurations to permit the head to be movable with respect to the support among a plurality of positions, whereby the apparatus is structured such that the torque supplied at the delivery point corresponds substantially consistently with the torque of the mechanical effort supplied by the driver independent of the position of the head.

33. The apparatus of claim 32, wherein the first and second teeth each include a tip and a root; and the tips of the first teeth generally being spaced from the roots of the second teeth, and the tips of the second teeth generally being spaced from the roots of the first teeth, when the first and second teeth are inter-engaged with one another.

34. The apparatus of claim 33, wherein the first and second teeth include tapers that are oriented generally oblique to the direction of the bias of the first and second teeth.

35. The apparatus of claim 34, wherein the indexing apparatus further including a lock that locks the first and second teeth together.

36. The apparatus of claim 35, wherein the lock includes a threaded member;

the first teeth being threadably cooperable with the threaded member; and the second teeth being disposed generally between the first teeth and the threaded member.

37. A method of transmitting mechanical effort between a driver and a delivery point, the driver providing the mechanical effort at up to a given level of torque, the delivery point being movable among a plurality of positions with respect to the driver, the method comprising:

supplying the mechanical effort at the delivery point at a torque that corresponds substantially consistently with the given level of torque independent of the position of the delivery point with respect to the driver, said supplying including:

operatively disposing a gear mechanism between the driver and the delivery point;

supporting the gear mechanism on a support;

providing an indexing apparatus having a first portion and a second portion;

affixing the first portion to the support;

biasing a number of tapered first teeth of the first portion and a number of tapered second teeth of the second portion into engagement with one another; and securing the second portion to the first portion in one of a plurality of configurations to secure the delivery point in one of the plurality of positions with respect to the driver.

38. The method of claim 37, wherein said securing the second portion to the first portion includes threadably locking the first and second portions together.

39. The method of claim 37, wherein said securing the second portion to the first portion in one of a plurality of configurations includes overcoming the bias between the first and second portions to disengage the first and second teeth from one another, and rotating one of the first and second portions with respect to the other of the first and second portions to move the delivery point to the one of the plurality of positions.

40. The method of claim 39, wherein said securing the second portion to the first portion in one of a plurality of configurations includes attaching a lock to the first portion and interposing at least a portion of the second portion between the lock and the first portion.

41. The method of claim 38, wherein said biasing the first and second teeth into engagement includes retaining the tips of the first teeth generally spaced from the roots of the second teeth, and retaining the tips of the second teeth generally spaced from the roots of the first teeth.

42. The method of claim 37, wherein said supporting the gear mechanism on a support includes longitudinally supporting a gear member of the gear mechanism with a first bearing and radially supporting the gear member with a second bearing.

43. The method of claim 42, wherein said supporting the gear mechanism on a support includes radially supporting a pinion gear and resisting longitudinal movement of the pinion gear away from the gear member.

44. The method of claim 43, wherein said supporting the gear mechanism on a support includes resisting longitudinal movement of the pinion gear toward the gear member.

* * * * *